United States Patent [19]

Schultheiss

[11] 4,272,842

[45] Jun. 9, 1981

[54] SUSPENSION DEVICE FOR THE CLOCKWORK OF A CLOCK

[75] Inventor: Udo Schultheiss, Schramberg, Fed. Rep. of Germany

[73] Assignee: Gebruder Junghans GmbH, Schramberg, Fed. Rep. of Germany

[21] Appl. No.: 68,597

[22] Filed: Aug. 22, 1979

[30] Foreign Application Priority Data

Sep. 12, 1978 [DE] Fed. Rep. of Germany ... 7827033[U]

[51] Int. Cl.[3] ..... G04B 37/00

[52] U.S. Cl. ..... 368/316; 368/276

[58] Field of Search ..... 58/53–56, 58/88 R; 206/18, 301; 248/114, 115; 368/276, 316

[56] References Cited

U.S. PATENT DOCUMENTS

| | | | |
|---|---|---|---|
| 2,219,354 | 10/1940 | Ciccarelli | 58/56 |
| 3,016,686 | 1/1962 | Fox | 58/56 |
| 3,996,736 | 12/1976 | Bodet | 58/56 |

*Primary Examiner*—Ulysses Weldon

*Attorney, Agent, or Firm*—Burns, Doane, Swecker & Mathis

[57] ABSTRACT

A suspension device is disclosed for a clock having a clockwork and a housing. The suspension device comprises a bracket which is mounted on a first section of the housing and protrudes, at least partially, into the clockwork-holding area. The suspension bracket carries the clockwork and also includes an opening for receiving a mounting hook for securing the clock to a wall or the like. This arrangement allows the production of a dimensionally symmetrical unit which can be inserted into a packing device in a pre-arranged upright position or even upside down.

5 Claims, 5 Drawing Figures

SUSPENSION DEVICE FOR THE CLOCKWORK OF A CLOCK

RELATED APPLICATIONS

The related disclosures of the following copending U.S. applications, filed simultaneously herewith, are incorporated herein by reference as if set forth at length:

1. U.S. Application Ser. No. 68,591 by Robert Wolber et al (corresponding to German Application No. G 78 27 035.6 filed Sept. 12, 1978).
2. U.S. Application Ser. No. 68,590 by Robert Wolber et al (corresponding to German Application No. G. 78 27 030.1 filed Sept. 12, 1978).
3. U.S. Application Ser. No. 68,620 by Robert Wolber et al (corresponding to German Application No. G 78 27 031.2 filed Sept. 12, 1978).
4. U.S. Application Ser. No. 68,619 by Hans Flaig et al (corresponding to German Application No. P 28 39 611.4-34 filed Sept. 12, 1978).
5. U.S. Application Ser. No. 68,598 by Roland Maurer (corresponding to German Application No. G 78 27 034.5 filed Sept. 12, 1978).
6. U.S. Application Ser. No. 68,595 by Friedrich Assmus (corresponding to German Application No. P 28 39 554.2-31 filed Sept. 12, 1978).
7. U.S. Application Ser. No. 68,596 by Robert Wolber et al (corresponding to German Application No. P 28 39 555.3-31 filed Sept. 12, 1978).

BACKGROUND AND OBJECTS OF THE INVENTION

The present invention concerns a suspension device for a clock.

Clockwork housings are usually rectangular in design, with the clock-hand shafts emerging centrally from the housings. Clockwork housings are also provided in many instances with a suspension bracket which is arranged on top, for example, in a kitchen clock. However, such an arrangement increases the overall dimensions of the clockwork. Furthermore, as regards clock-hand shafts which protrude centrally from the housing, a suspension bracket placed at the outer surfaces of the housing results in an asymmetrical shape of the unit which is disadvantageous, especially for packing purposes.

It is, therefore, an object of the invention to attach a suspension device of the above-described type to the clock housing in such manner that, when one considers the clock-hand shafts protruding from the housing to constitute produced dimension-wise which can be inserted into any prepared packing arrangement, even upside down.

BRIEF SUMMARY OF THE INVENTION

This object is achieved by a suspension bracket which is formed onto a first section of a clock housing. The bracket extends at least partially into a clockwork receiving area of the housing and is adapted to support the clock from an attaching structure as well as carry the clockwork. Since the suspension bracket of the present invention extends at least partially into the clockwork-holding area of the housing, there is created a unit which is dimensionally symmetrical about the clock-hand shafts and which can be inserted into any packing device upright or upside down, thus avoiding involved manipulations and making possible an economic packing of the clock.

THE DRAWING

A preferred embodiment of the invention will be described below in detail with reference to the drawing wherein:

FIG. 1 is a rear view of a front section 1 of a clockwork housing, with the rear housing section and clockwork removed, but depicting the suspension bracket of the invention, FIG. 2 is a sectional view of the front housing section taken along line II—II in FIG. 1, FIG. 3 is a front view of a rear section of the housing, FIG. 4 is a rear view of the rear housing section, and FIG. 5 is a rear view of the housing with the clock mounted inside a packing device after assembly.

DETAILED DESCRIPTION OF A PREFERRED EMBODIMENT OF THE INVENTION

Figure 1:
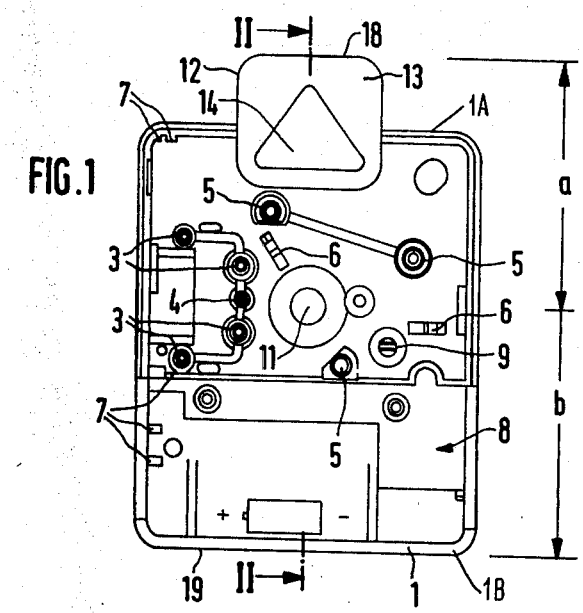

Like parts are denoted by like reference numerals in the figures. The moving parts of the clockwork were omitted in the figures because they are conventional and are not relevant so far as the understanding of the present invention is concerned. See above-referenced U.S. Application Ser. No. 68,595 for such details.

A clockwork housing is formed by a first section 1 and a second section 2. The first housing section 1 includes a top wall 1A and a bottom wall 1B. Both sections 1, 2 are made of synthetic material such as plastic and are detachably connected with each other by means of conventional locking projections or recesses which are arranged on these sections. Also arranged at the two sections of the housing are mountings and retaining elements (see FIGS. 1 to 3) for the various parts of the clockwork. In this regard, support posts 3 with pins attached at the ends serve for the mounting of the stator laminations of a stepping motor, while support 4 carries a mount for the rotor of this motor. A divider plate (not shown) rests on support posts 5 and is held in place in housing section 1 by locking supports 6. The latter are fastened to this section 1 and carry locking projections which engage the rear of the divider plate edges. A clockwork, including the stepping motor, is mounted partially within the space between the bottom of the section 1 of the housing and the divider plate, and partially in the space between the divider plate and the bottom of the housing section 2 at mounting points appropriately arranged on these parts.

A circuit board, on which are mounted the static components of the stepping motor, is held in section 1 of the housing by a number of guiding ribs 7.

In a battery area 8 of section 1 of the housing there are mounted a battery and a battery contact element. The latter supplies the circuit board with electric current and holds the board securely in the housing section 1. A second contact element, fitting to the other terminal of the battery, is fastened to the circuit board. A clock-hand setting shaft is mounted on a support 9 and projects from the casing through a bore 10 in the second section 2 of the housing.

For additional description of the clockwork and its driving mechanism and the manner of securement of the driving mechanism within the housing, attention is directed to the above-referenced U.S. Application Ser. No. 68,596 of Robert Wolber et al, entitled *Electrical Contact Arrangement for a Battery-Operated Instrument.*

The shafts of the clockwork controlling the clock-hands extend through a bore 11 in the housing section 1.

In accordance with the invention, a suspension bracket 12 is connected to housing section 1 in such manner that it extends below the top wall 1A and protrudes, at least partially, into the clockwork-holding area and forms the suspension for the clockwork. The suspension bracket 12 includes a holding plate 13 and an aperture 14 therein which receives a hanging hook or the like from which a clock, when equipped with the clockwork system, can be suspended. The suspension bracket 12 is further provided with several reinforcing ribs 15 (FIG. 2) which increase its rigidity and effectively resist deformation of the housing. Two of the ribs 15 are vertically spaced and lie mutually parallel. One of the ribs 15 extends from a lower end of said plate-like suspension member and over the clockwork area.

Figure 3:
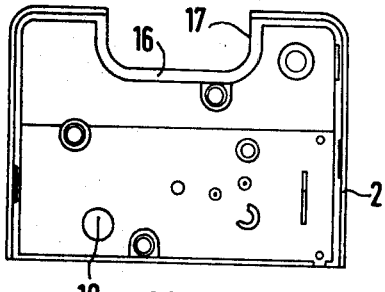
Figure 4:
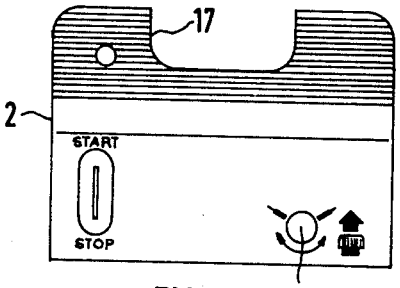
Figure 5:
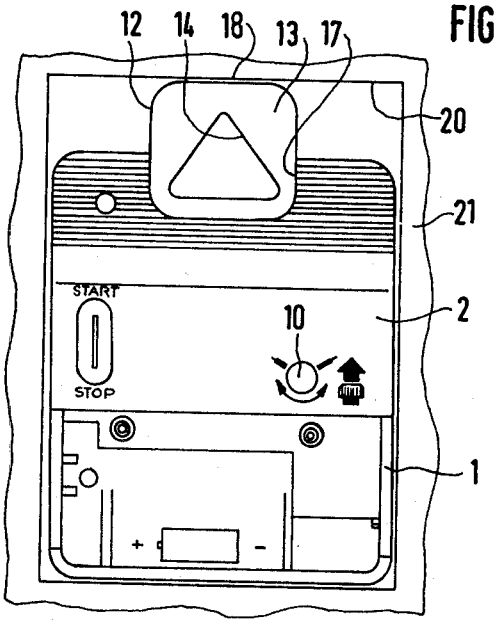

This specific design of the suspension bracket requires a corresponding matching shape of the housing section 2 to conform with the outer shape of the bracket as illustrated in FIGS. 3 to 5. The housing section 2 is provided for this purpose with a recess 17 which is strengthened by a reinforcing rib 16. The suspension bracket 12 extends into the recess 17 (FIG. 5).

Figure 2:
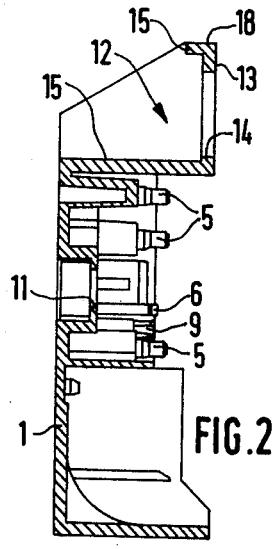

From FIGS. 1 and 2 it is apparent that the distance a between the upper edge 18 of the suspension bracket 12 and the axis of the bore 11 (through which the clock-hand shafts extend), equals the distance b between this axis and the lower edge 19 of housing section 1.

It is thus possible to accommodate the clockwork in a recess 20 of a packing arrangement 21 as shown in FIG. 5, or to place the same upside down therein.

If these distances were not equal, it would become necessary to specifically align the clockwork with the recess in the packing device due to the protruding clock-hand shafts.

Although the invention has been described in connection with a preferred embodiment thereof, it will be appreciated by those skilled in the art that additions, substitutions, modifications, and deletions not specifically described, may be made without departing from the spirit and scope of the invention as defined in the appended claims.

What is claimed is:

1. A clock comprising a two-section housing, a first of said housing sections presenting a clockwork receiving area which receives a clockwork, the second of said housing sections being removably insertable onto said first housing section to close said area, said first housing section being formed with a suspension means comprising a plate-shaped suspension member and a suspension aperture therethrough, said plate-like member and aperture projecting partially into said clockwork receiving area, said plate-like suspension member having a plurality of stiffening ribs projecting outwardly therefrom and joining said plate-like suspension member to said first housing section.

2. A clock according to claim 1, wherein one of said stiffening ribs extends from a lower end of said plate-like suspension member and over said clockwork receiving area.

3. A clock according to claim 1, wherein said suspension aperture extends above an uppermost edge of said first housing part.

4. A clock according to claim 1, wherein two of said ribs are vertically spaced and lie mutually parallel.

5. A clock according to claim 1, wherein said clockwork receiving area includes a rotary axis for time-indicating hands, the distance between an uppermost edge of said suspension member and said axis being equal to the distance between said rotary axis and a lowermost edge of said first housing section.

* * * * *